US007364235B2

(12) United States Patent
Chen et al.

(10) Patent No.: US 7,364,235 B2
(45) Date of Patent: Apr. 29, 2008

(54) CHAIR WITH AN ADJUSTABLE BACKREST

(75) Inventors: Shun-Min Chen, Taipei (TW); Hong-Bin Xu, Taipei (TW)

(73) Assignee: Wonderland Nursery Goods, Co., Ltd. (TW)

( * ) Notice: Subject to any disclaimer, the term of this patent is extended or adjusted under 35 U.S.C. 154(b) by 0 days.

(21) Appl. No.: 11/583,926

(22) Filed: Oct. 20, 2006

(65) Prior Publication Data

US 2008/0001459 A1 Jan. 3, 2008

(30) Foreign Application Priority Data

Jun. 20, 2006 (CN) ..... 2006 2 0120423

(51) Int. Cl.
*A47B 83/02* (2006.01)

(52) U.S. Cl. ..... 297/377; 297/148; 297/152; 297/354.12; 297/354.13; 297/357

(58) Field of Classification Search ..... 297/377, 297/148, 152, 354.12, 354.13, 357
See application file for complete search history.

(56) References Cited

U.S. PATENT DOCUMENTS

| | | | | |
|---|---|---|---|---|
| 778,526 | A * | 12/1904 | Bennett | 297/357 X |
| 4,805,928 | A | 2/1989 | Nakao et al. | |
| 4,938,603 | A * | 7/1990 | Turner et al. | 297/153 X |
| 6,334,652 | B1 * | 1/2002 | Chen et al. | 297/357 |
| 6,666,505 | B2 * | 12/2003 | Greger et al. | 297/148 |
| 7,008,018 | B2 * | 3/2006 | Chen | 297/363 |
| 7,219,959 | B2 * | 5/2007 | Ransil et al. | 297/277 |
| 2005/0029852 | A1 * | 2/2005 | Chen | 297/354.12 |

FOREIGN PATENT DOCUMENTS

| | | |
|---|---|---|
| GB | 2358793 | 8/2001 |
| GB | 2391801 | 2/2004 |
| GB | 2404579 | 2/2005 |
| GB | 2414389 | 11/2005 |

OTHER PUBLICATIONS

Search Report mailed Jun. 6, 2007 in corresponding application No. GB0620475.4.

* cited by examiner

*Primary Examiner*—Rodney B. White
(74) *Attorney, Agent, or Firm*—Davidson Berquist Jackson & Gowdey LLP

(57) ABSTRACT

A chair includes a positioning unit that is provided in a receiving portion of an armrest and that includes shorter and taller stop portions. A positioning member is retained movably on a rear side of a backrest, and has one end extending into the receiving portion to abut against a selected one of the stop portions. An operating unit is connected to and is operable to move the positioning member for selectively disengaging and engaging the stop portions. A safety mechanism is provided on the backrest and the operating unit, and is operable in either a limiting state, where the positioning member is unable to move past the taller stop portion, or a non-limiting state, where the positioning member is able to move past the taller stop portion.

14 Claims, 9 Drawing Sheets

CHAIR WITH AN ADJUSTABLE BACKREST

CROSS-REFERENCE TO RELATED APPLICATION

This application claims priority of Chinese application no. 200620120423.8, filed on Jun. 20, 2006.

BACKGROUND OF THE INVENTION

1. Field of the Invention

The invention relates to a chair, more particularly to a chair with an adjustable backrest.

2. Description of the Related Art

FIG. 1 shows a conventional highchair 1 disclosed in GB 2,358,793. The highchair 1 includes a seat 3 and a support structure 2. The seat 3 includes a body 13 with a sitting portion 15 and a backrest 14. The body 13 is provided with lateral sidepieces 16 (only one is visible) that are connected to lateral elements 7 (only one is visible) of the support structure 2. A control component 25 is disposed on a rear side of the backrest 14, and is operable in a direction (X) as shown in the Figure when it is desired to change an inclination of the seat 3.

The lateral elements 7 of the support structure 2 are provided with box structures 17 to connect the seat 3 to the support structure 2. Each box structure 17 has two portions (17I, 17II), and the corresponding sidepiece 16 of the seat 3 is positioned between the two portions (17I, 17II). An inverted U-shaped component 21 is disposed on the rear side of the backrest 14, and is driven by the control component 25. The inverted U-shaped component 21 includes a pair of lateral rods 23, each of which is provided with a coupling seat 28 and extends into the corresponding box structure 17. The coupling seat 28 is provided with a pin 29, which engages selectively one of three spaced apart grooves 35 formed in the corresponding box structure 17 upon operation of the control component 25 such that the seat 3 can be retained at a desired inclination relative to the support structure 2. A spring 37 connects a corresponding coupling seat 28 to the corresponding box structure 17 in order to provide a restoring force.

In use, the control component 25 on the rear side of the backrest 14 is operated to drive the two lateral rods 23 of the inverted U-shaped component 21 such that the pins 29 are disengaged from a current pair of the grooves 35 in order to permit adjustment of the backrest 14 to the desired reclining angle. After adjusting the backrest 14 to the desired reclining angle, the control component 25 is released, and the springs 37 (only one is visible) urge the lateral rods 23 and the associated pins 29 to engage another pair of the grooves 35 for retaining the seat 3 at the desired inclination.

SUMMARY OF THE INVENTION

The main object of the present invention is to provide a chair, which permits reclining adjustment of a backrest through an operating unit that drives movement of a positioning member relative to a positioning unit.

Another object of the present invention is to provide a chair, which has a safety mechanism that can limit reclining adjustment of a backrest.

Accordingly, a chair of the present invention comprises a seat, a backrest connected pivotally to the seat, an armrest, a positioning unit, a positioning member, an operating unit, and a safety mechanism.

The armrest is disposed at a lateral side of the seat, and has a receiving portion.

The positioning unit is provided in the receiving portion of the armrest, and includes a first positioning block formed with a first stop portion, and a second positioning block formed with a second stop portion and spaced apart from the first positioning block in a first direction. Each of the first and second stop portions has a height in a second direction substantially transverse to the first direction. The height of the second stop portion is greater than that of the first stop portion.

The positioning member is retained movably on a rear side of the backrest, and has one end that is extended into the receiving portion of the armrest and that is disposed to abut against a selected one of the first and second stop portions.

The operating unit is connected to the positioning member, and is operable to drive movement of the positioning member relative to the backrest and the positioning unit in the receiving portion of the armrest for disengaging the end of the positioning member from the first and second stop portions and for subsequently engaging the end of the positioning member with the selected one of the first and second stop portions.

The safety mechanism includes a first limit component provided on the backrest, and a second limit component provided on the operating unit. The safety mechanism is operable in one of a limiting state, where the first limit component cooperates with the second limit component so that the end of the positioning member is displaceable in the second direction in response to operation of the operating unit by a shorter distance sufficient to move past the height of the first stop portion but insufficient to move past the height of the second stop portion, and a non-limiting state, where the first and second limit components permit displacement of the end of the positioning member in the second direction in response to operation of the operating unit by a longer distance that is longer than the shorter distance and that is sufficient for the end of the positioning member to move past the height of the second stop portion.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
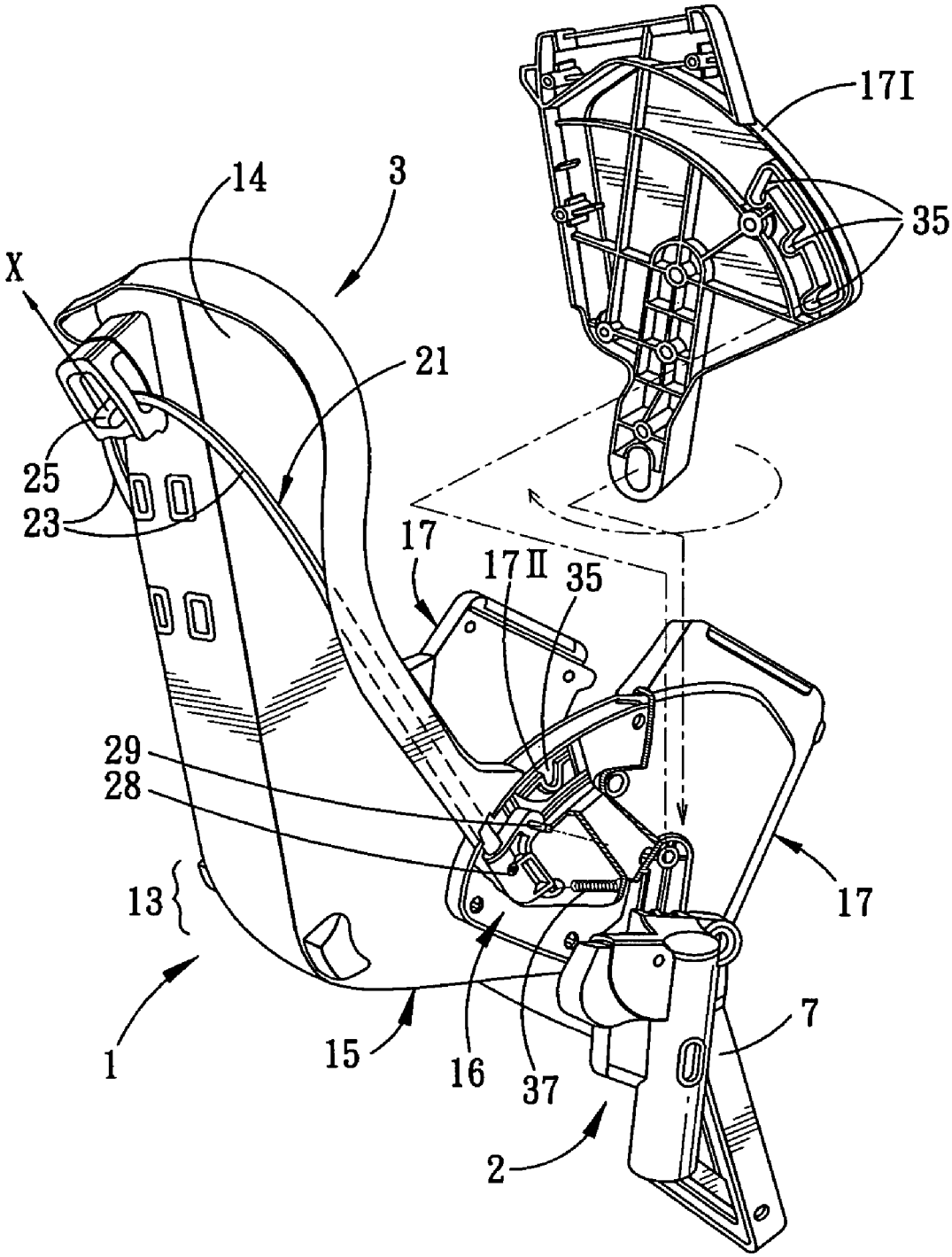
FIG. 1 PRIOR ART
FIG. 1 is a partly exploded perspective view of a conventional highchair.
Figure 2:
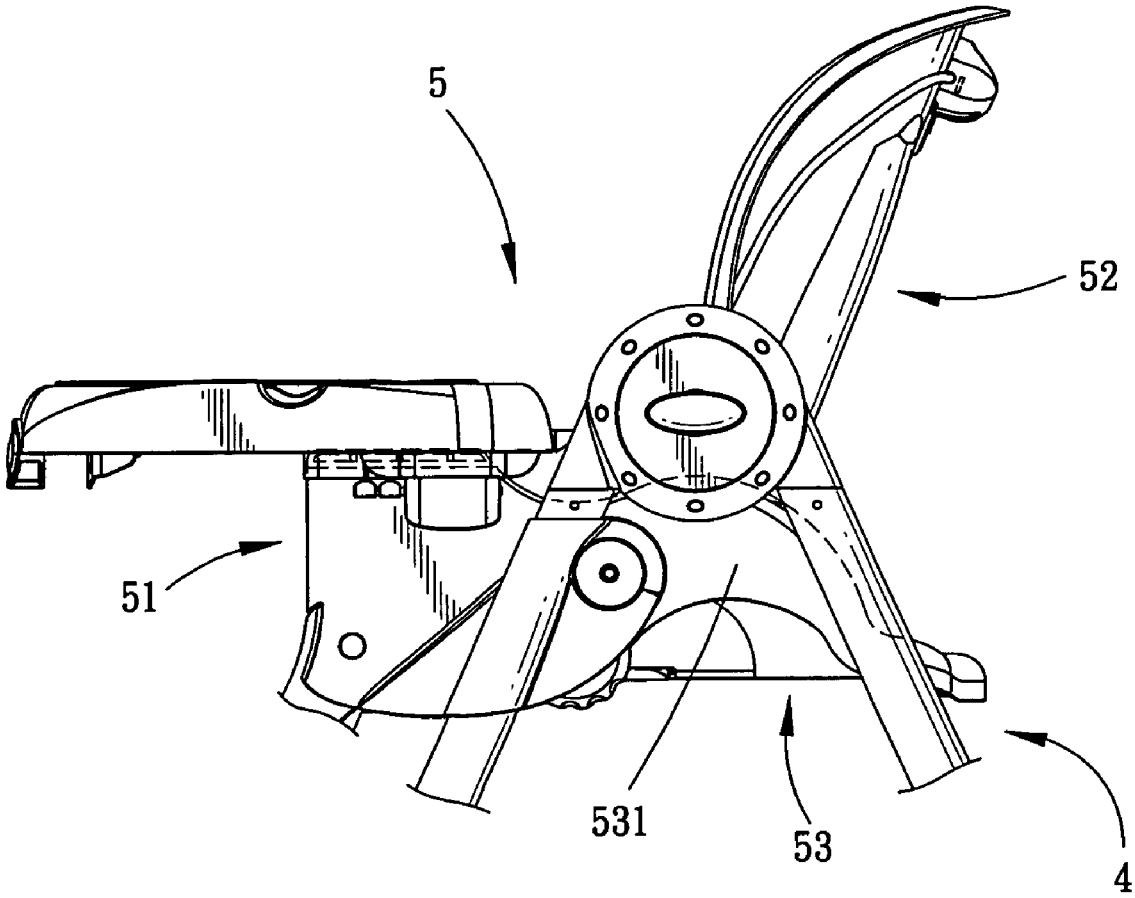
FIG. 2 is a fragmentary schematic side view of the preferred embodiment of a chair according to the present invention.
Figure 3:
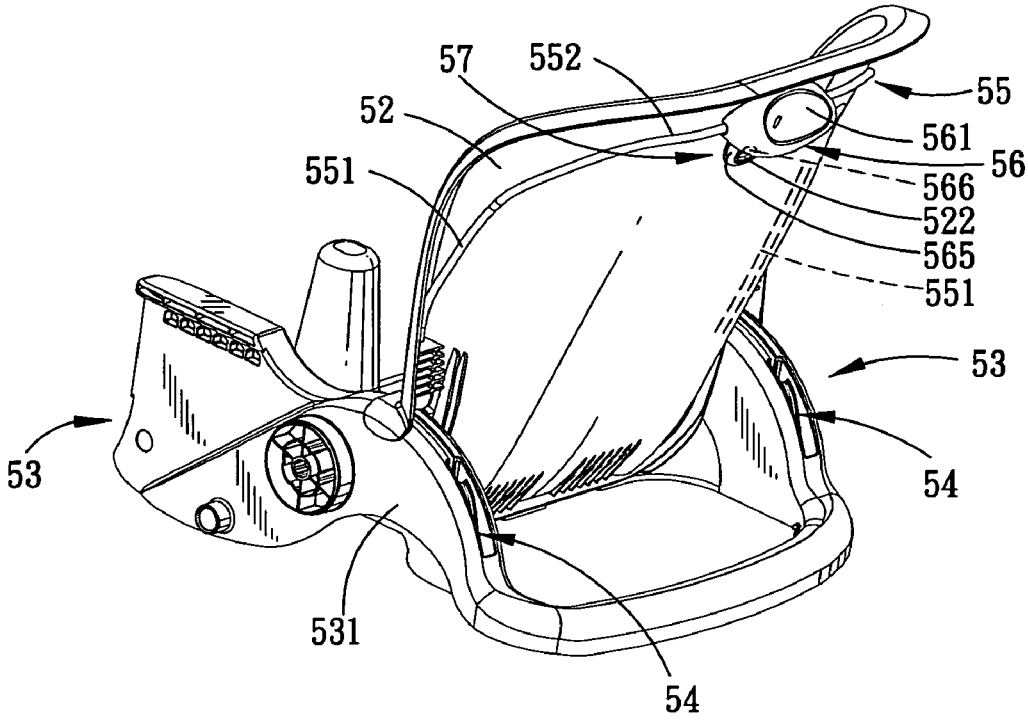
FIG. 3 is a rear perspective view of the preferred embodiment.

Referring to FIGS. 2 and 3, the preferred embodiment of a chair 5 according to the present invention is shown to be in the form of a highchair. The chair 5 includes a leg unit 4, a seat 51, a backrest 52 connected pivotally to the seat 51, a pair of arm rests 53, a pair of positioning units 54, a positioning member 55, an operating unit 56, and a safety mechanism 57.

Each of the armrests 53 is connected to the leg unit 4, is disposed at a respective lateral side of the seat 51, has the backrest 52 connected pivotally thereto, and further has a receiving portion 531.

Figure 4:
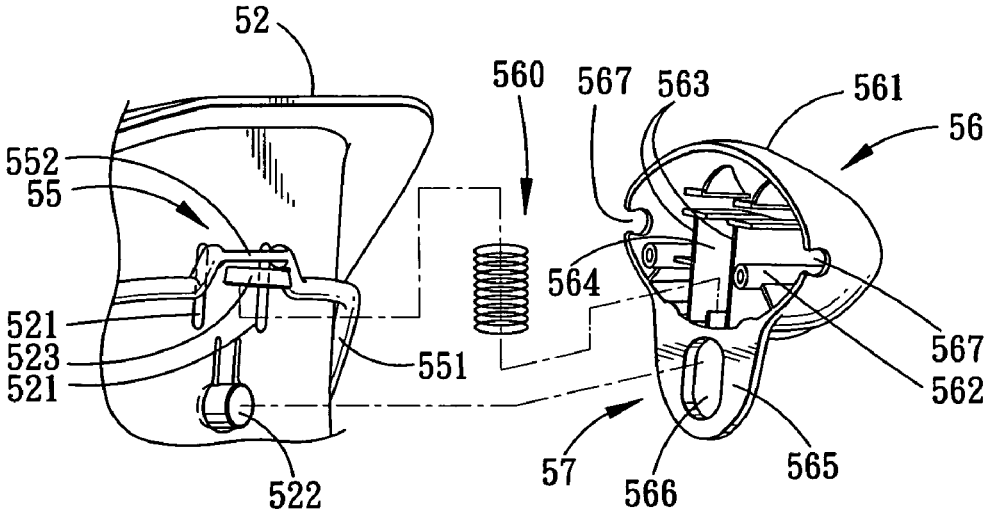
FIG. 4 is a fragmentary exploded perspective view to illustrate a backrest, an operating unit, a safety mechanism and a spring of the preferred embodiment.
Figure 5:
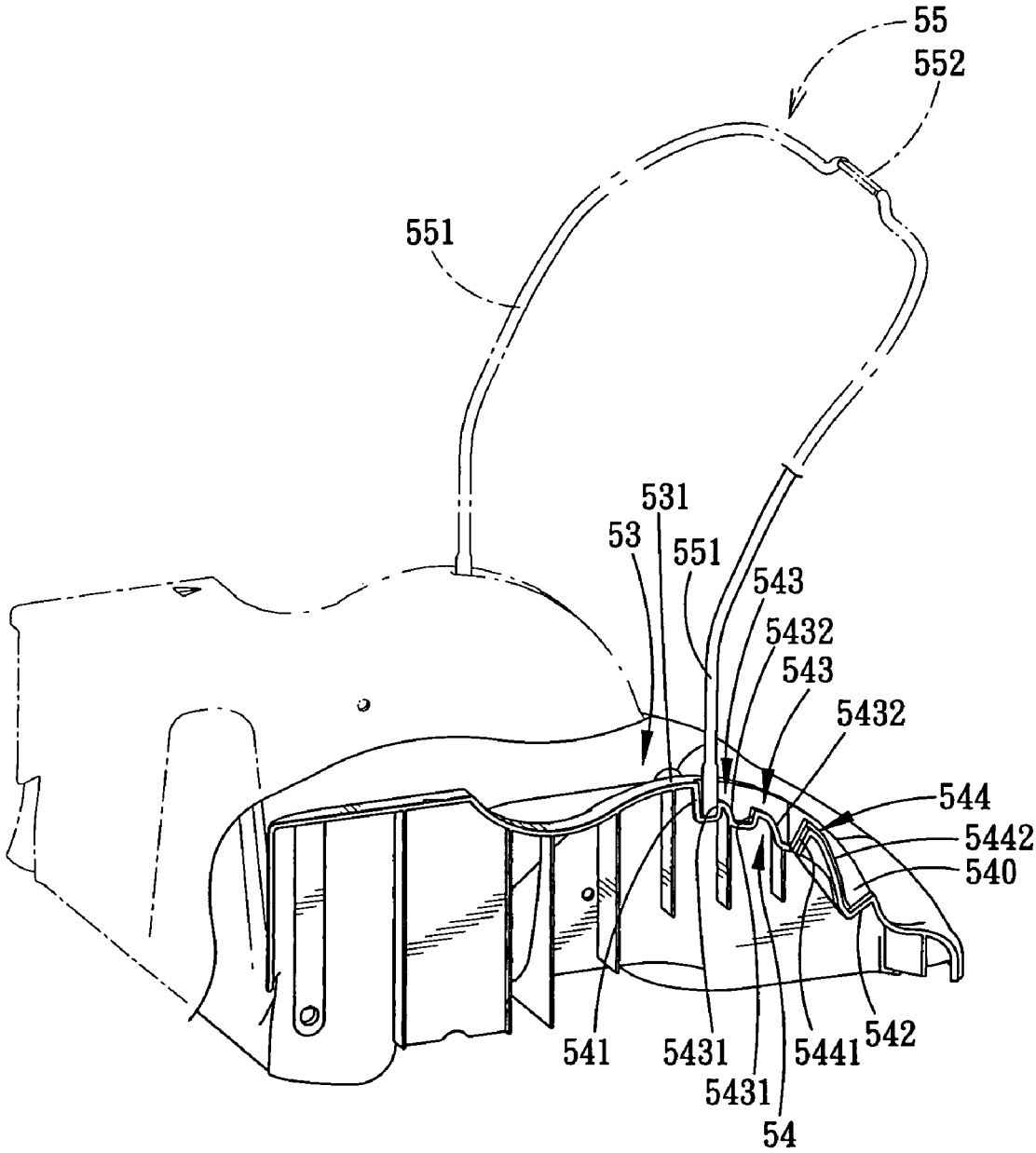
FIG. 5 is a fragmentary perspective view to illustrate a positioning member and a positioning unit of the preferred embodiment.

Referring further to FIGS. 4 and 5, each of the positioning units 54 is provided in the receiving portion 531 of a respective one of the armrests 53, and has a first (front) end wall 541, a second (rear) end wall 542, and an open-ended groove 540 defined between the first and second end walls 541, 542. Each positioning unit 54 includes an adjacent pair of first (front) positioning blocks 543 and a second (rear) positioning block 544 disposed in the open-ended groove 540. Each first positioning block 543 is formed with a substantially upright first stop portion 5431. The second positioning block 544 is formed with a substantially upright second stop portion 5441 and is spaced apart from the first positioning blocks 543 in a first (front-to-rear) direction. Each of the first positioning blocks 543 further has a curved portion 5432 opposite to the first stop portion 5431 and facing toward the second positioning block 544. The second positioning block 544 further has a curved portion 5442 opposite to the second stop portion 5441 and facing toward the second end wall 542. Preferably, the curved portions 5441, 5442 are curved in the same direction. The first and second positioning blocks 543, 544 thus configure each of the positioning units 54 with a ratchet-teeth design. In addition, each stop portion 5431, 5441 has a height in a second (upright) direction substantially transverse to the first direction. The height of the second stop portion 5441 is greater than that of the first stop portions 5431, the purpose of which will be described in greater detail in the succeeding paragraphs.

The positioning member 55 is inverted U-shaped in this embodiment, is retained movably on a rear side of the backrest 52, and includes a parallel pair of extending segments 551 and a connecting segment 552 that interconnects the extending segments 551. Each of the extending segments 551 has one end that is extended into the receiving portion 531 of a respective armrest 53 and that is disposed to abut against a selected one of the first and second stop portions 5431, 5441.

The operating unit 56 is connected to the connecting segment 552 of the positioning member 55, and is operable to drive upward and downward movement of the positioning member 55 relative to the backrest 52 and the positioning units 54 in the receiving portions 531 of the armrests 53 for disengaging the ends of the extending segments 551 of the positioning member 55 from the first and second stop portions 5431, 5441 and for subsequently engaging the ends of the extending segments 551 of the positioning member 55 with the selected stop portion 5431, 5441. In this embodiment, the operating unit 56 includes a cap body 561 that has a peripheral edge formed with an aligned pair of retaining grooves 567, and a tongue 565 that extends downwardly and outwardly from the cap body 561. Each of the retaining grooves 567 has a restricted access end. The connecting segment 552 of the positioning member 55 is retained by the retaining grooves 567 of the cap body 561 such that the operating unit 56 is able to drive movement of the positioning member 55.

Figure 6:
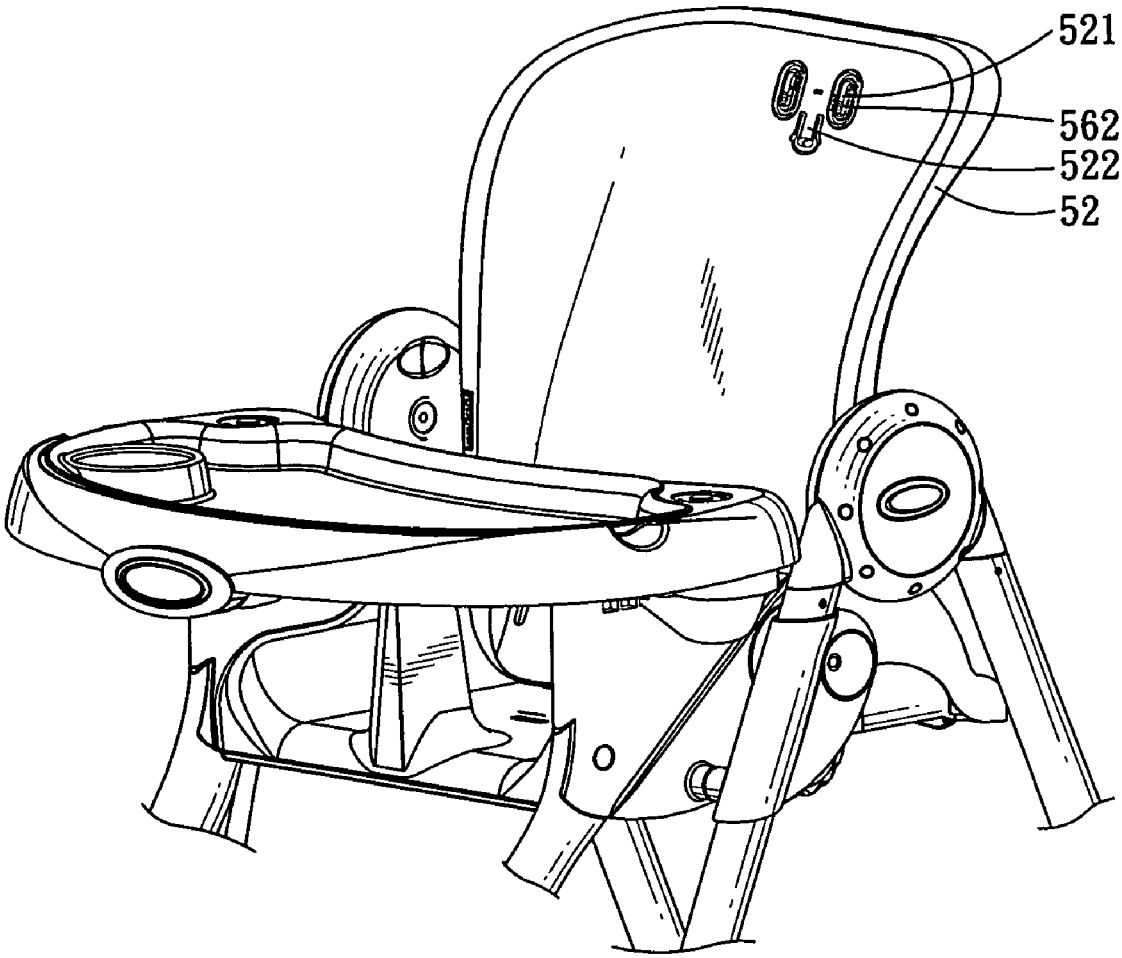
FIG. 6 is a front perspective view of the preferred embodiment.

Referring further to FIG. 6, the backrest 52 is formed with a pair of elongate vertical guide slots 521. The cap body 561 of the operating unit 56 is provided with a pair of guide pins 562 that are slidably and respectively retained at the guide slots 521 to guide movement of the operating unit 56 relative to the backrest 52. In this embodiment, the guide pins 562 are secured to the backrest 52 using rivets (not shown) that extend therein.

The safety mechanism 57 includes a first limit component 522 provided on the backrest 52, and a second limit component 566 provided on the operating unit 56. The safety mechanism 57 is operable in one of a limiting state, where the first limit component 522 cooperates with the second limit component 566 so that the ends of the extending segments 551 of the positioning member 55 are displaceable in the second (upright) direction in response to operation of the operating unit 56 by a shorter distance sufficient to move past the height of the first stop portions 5431 but insufficient to move past the height of the second stop portion 5441, and a non-limiting state, where the first and second limit components 522, 566 permit displacement of the ends of the extending segments 551 of the positioning member 55 in the second direction in response to operation of the operating unit 56 by a longer distance that is longer than the shorter distance and that is sufficient for the ends of the extending segments 551 of the positioning member 55 to move past the height of the second stop portion 5441. In this embodiment, the second limit component 566 is an elongate upright slot formed in the tongue 565 of the operating unit 56, and the first limit component 522 is a resilient finger that is formed integrally with the backrest 52, that projects from the rear side of the backrest 52, and that extends into the second limit component 566 when the safety mechanism 57 is operated in the limiting state. Accordingly, when the safety mechanism 57 is operated in the limiting state, movement of the positioning member 55 is limited by the length of the second limit component 566 due to extension of the first limit component 522 into the second limit component 566, and by the guide pins 562 of the operating unit 56 that are slidably retained at the guide slots 521 in the backrest 52. The first limit component 522 is depressible to extend out of the second limit component 566 to switch the safety mechanism 57 from the limiting state to the non-limiting state. Accordingly, when the safety mechanism 57 is operated in the non-limiting state, movement of the positioning member 55 is no longer limited by the length of the second limit component 566 since the first limit component 522 ceases to extend into the second limit component 566, but is still limited by the guide pins 562 of the operating unit 56 and the guide slots 521 in the backrest 52.

Referring once again to FIG. 4, the chair 5 further includes a spring 560 for biasing the operating unit 56 toward the armrests 53. The spring 560 has a first end acting on the backrest 52, and a second end acting on the operating unit 56. In this embodiment, the operating unit 56 is formed with a parallel pair of upright confining walls 563 that confine a chamber 564 for accommodating the spring 560. The backrest 52 is formed with a tab 523 that extends into the chamber 564 to abut against the first end of the spring 560. When the operating unit 56 is in a normal or non-operated state, the spring 560 biases the operating unit 56 downwardly until the guide pins 562 are disposed at lower ends of the guide slots 521 (see FIG. 7) such that the ends of the extending segments 551 of the positioning member 55 can abut firmly against the positioning units 54, as best shown in FIG. 5. Furthermore, the spring 560 accumulates a restoring force when the operating unit 56 is pulled upwardly relative to the backrest 52.

The design of the positioning units 54 in this embodiment provides four backrest positions. FIG. 5 illustrates a first backrest position, which is a vertical backrest position. At the first backrest position, the end of each extending segment 551 of the positioning member 55 is stopped by the first stop portion 5431 of a corresponding one of the first positioning blocks 543 that is closest to the first end wall 541, i.e., each extending segment 551 is stopped between the first end wall 541 and a front one of the first positioning blocks 543 of the corresponding positioning unit 54. Since the spring 560 biases the operating unit 56 downwardly such that the guide pins 562 are normally disposed at lower ends of the guide slots 521 (see FIG. 7), the ends of the extending segments 551 of the positioning member 55 are unable to move to a rear one of the first positioning blocks 543 of the corresponding positioning unit 54, thereby locking the backrest 52 at the first backrest position.

The first stop portions 5431 of the rear first positioning blocks 543 define a second backrest position, whereas the second stop portions 5441 of the second positioning blocks 544 define a third backrest position. As mentioned hereinabove, the height of the second stop portions 5441 is greater than the height of the first stop portions 5431. When the ends of the extending segments 551 of the positioning member 55 are stopped by the second stop portions 5441 of the second positioning blocks 544 (i.e., the backrest 52 is at the third backrest position), the ends of the extending segments 551 are unable to move past the height of the second stop portions 5441 when the operating unit 56 is pulled upwardly while the safety mechanism 57 is in the limiting state.

Referring once again to FIGS. 3 and 4, the safety mechanism 57 is designed such that, when the safety mechanism 57 is in the limiting state, the operating unit 56 can be operated for adjusting the backrest 52 to any one of the first, second and third backrest positions, but cannot be operated for adjusting the backrest 52 to the fourth backrest position, which is a horizontal backrest position. When the first limit component 522, which is in the form of a resilient finger on the backrest 52, extends into the second limit component 566, which is in the form of an elongate slot in the tongue 565 of the operating unit 56, the extent of upward movement of the operating unit 56 is limited by the length of the second limit component 566 such that the ends of the extending segments 551 of the positioning member 55 are displaceable in response to operation of the operating unit 56 by the shorter distance that is sufficient to move past the height of the first stop portions 5431 but insufficient to move past the height of the second stop portions 5441.

Figure 7:
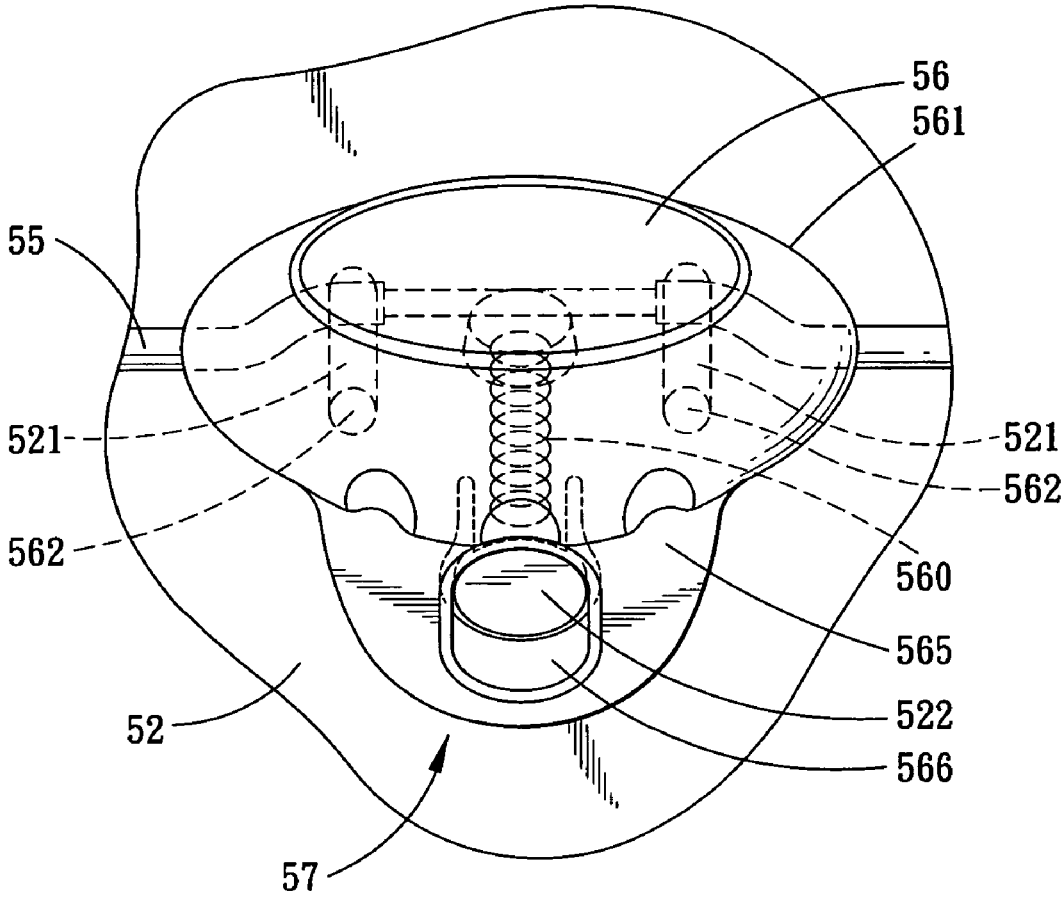
FIGS. 7, 8 and 9 are fragmentary schematic views to illustrate operation of a safety mechanism of the preferred embodiment.
Figure 8:
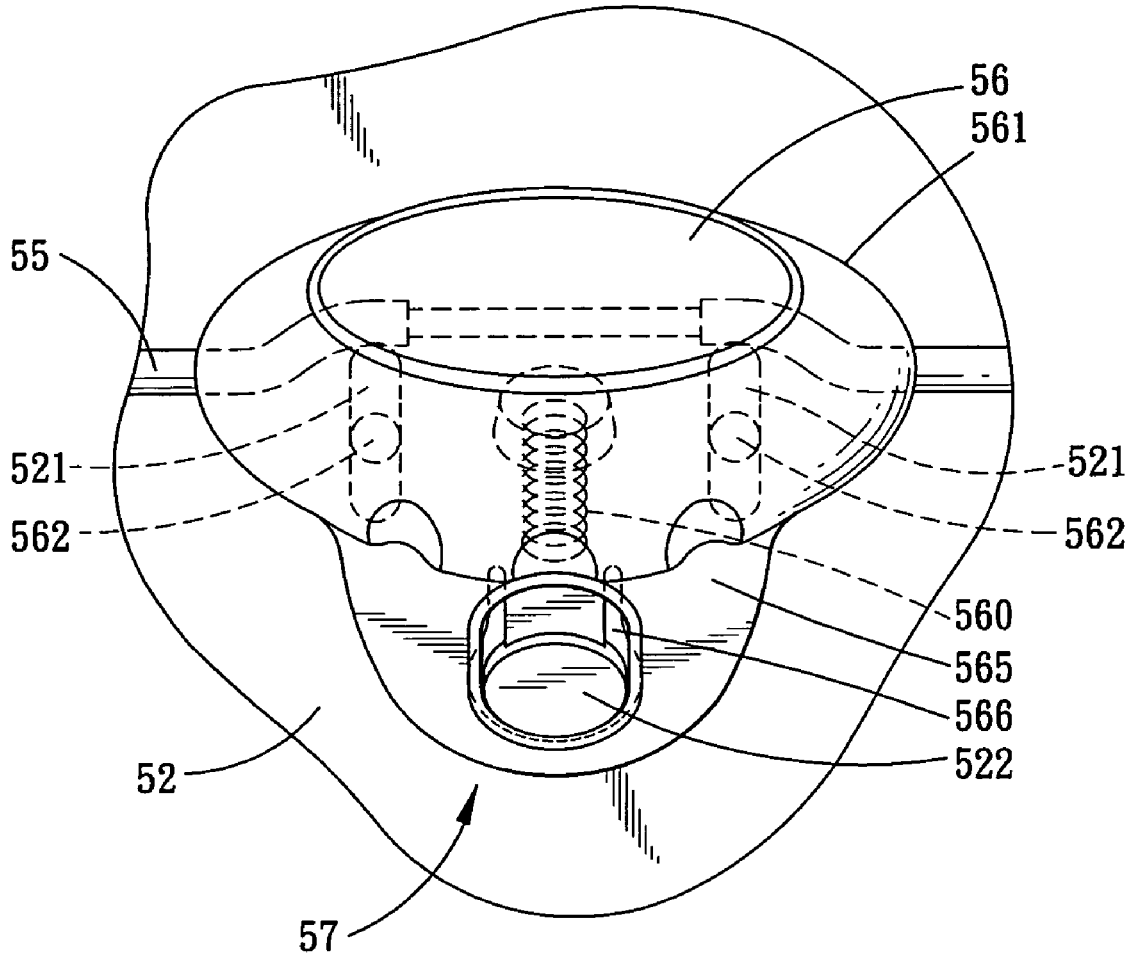

Therefore, when it is desired to move the backrest 52 from the first backrest position to the second backrest position, the operating unit 56 is pulled upwardly against the biasing action of the spring 560 so that the guide pins 562 slide along the guide slots 52 (see FIG. 8) such that the ends of the extending segments 551 of the positioning member 55 are disengaged from the first stop portions 5431 of the front ones of the first positioning blocks 543. At this time, the first limit component 522 is moved to a bottom slot-defining edge of the second limit component 566 to arrest further upward movement of the operating unit 56, and the backrest 52 can be pivoted rearward to move the ends of the extending segments 551 of the positioning member 55 to the first stop portions 5431 of the rear ones of the first positioning blocks 543. When the operating unit 56 is released, due to the restoring force accumulated by the spring 560, the operating unit 56 will move downward until the first limit component 522 abuts against a top slot-defining edge of the second limit component 566, as best shown in FIG. 7.

The operation for moving the backrest 52 from the second backrest position to the third backrest position is conducted in the same manner. That is, the operating unit 56 is pulled upwardly against the biasing action of the spring 560 to disengage the ends of the extending segments 551 of the positioning member 55 from the first stop portions 5431 of the rear ones of the first positioning blocks 543. At this time, the backrest 52 can be pivoted rearward to move the ends of the extending segments 551 of the positioning member 55 to the second stop portions 5441 of the second positioning blocks 544. When the operating unit 56 is released, due to the restoring force accumulated by the spring 560, the operating unit 56 will move downward until the first limit component 522 abuts once again against the top slot-defining edge of the second limit component 566, as best shown in FIG. 7.

Figure 9:
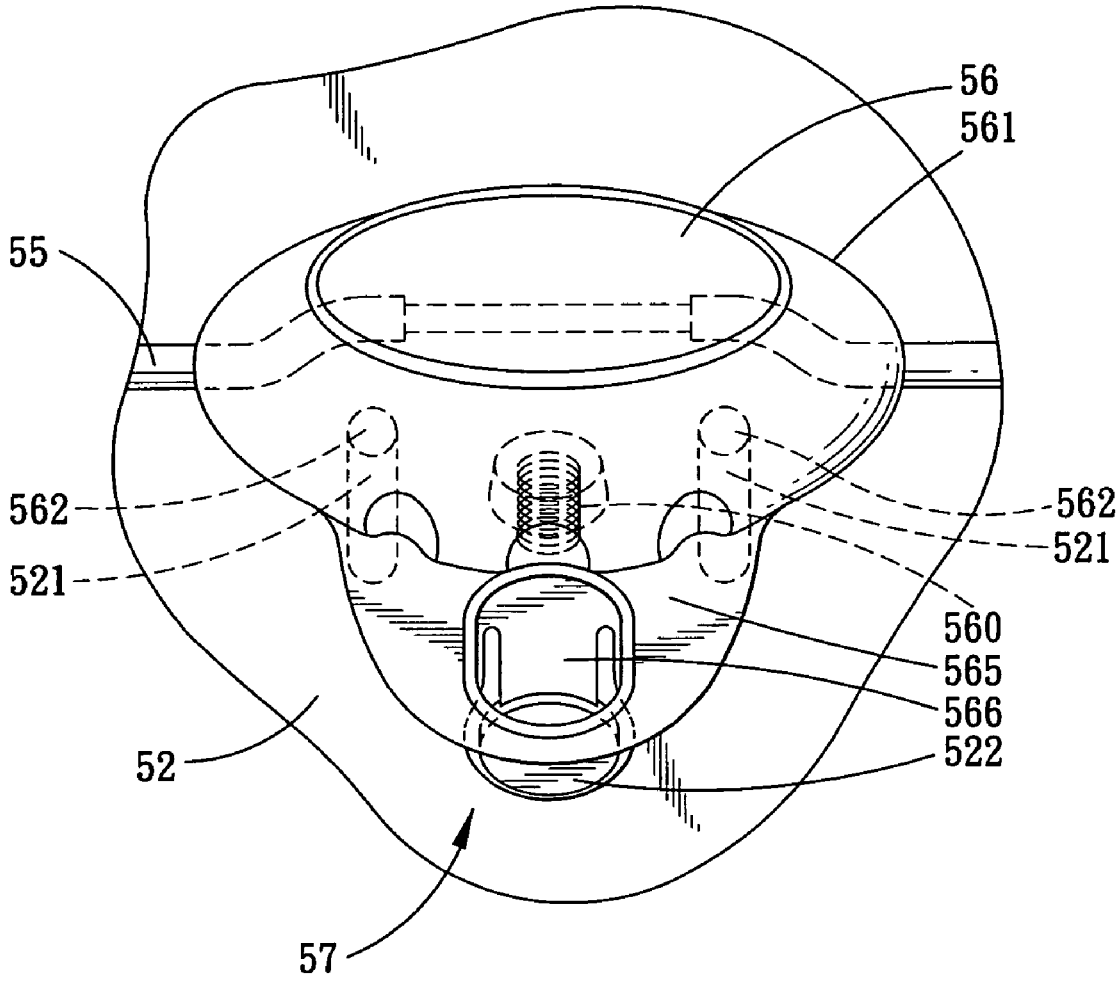
Figure 10:
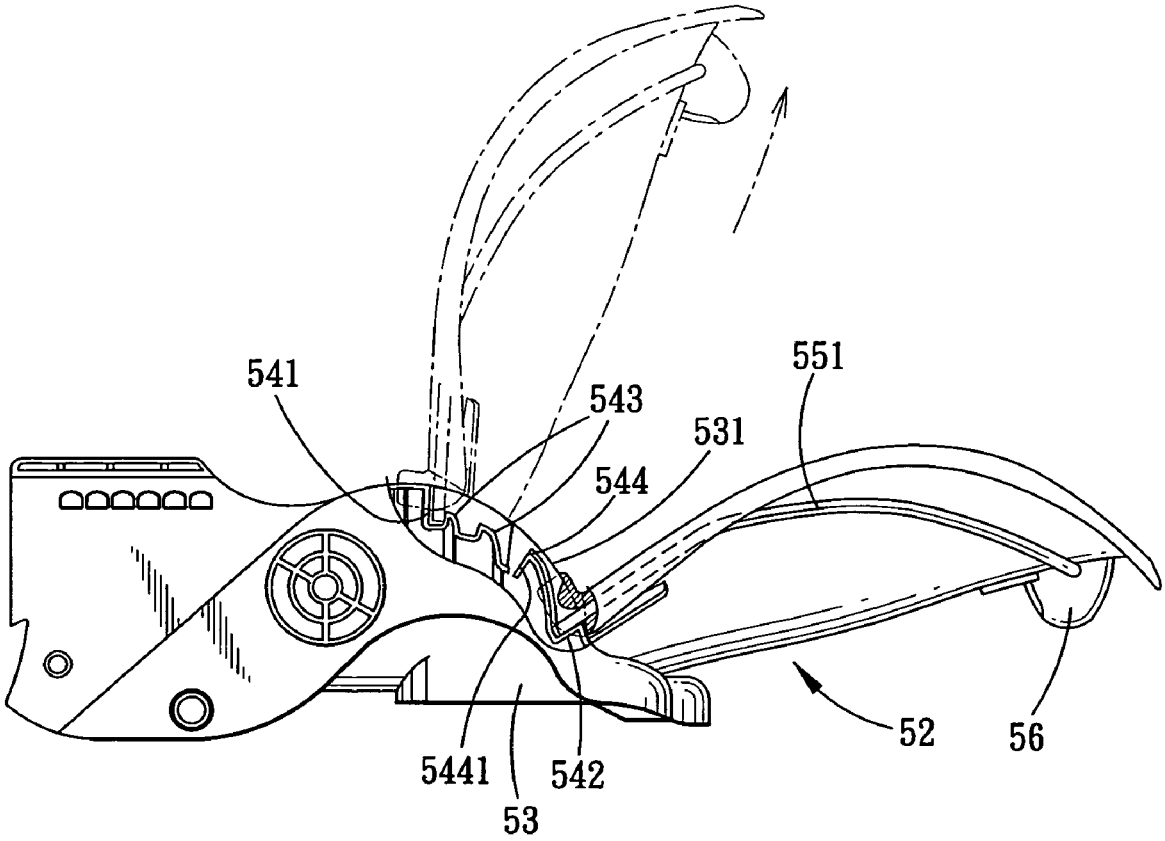
FIG. 10 is a fragmentary schematic side view of the preferred embodiment, illustrating a horizontal backrest position of the backrest.

When the backrest 52 is at the third backrest position, since the height of the second stop portions 5441 is greater than the height of the first stop portions 5431, the ends of the extending segments 551 of the positioning member 55 are unable to move past the height of the second stop portions 5441 when the operating unit 56 is pulled upward while the safety mechanism 57 is in the limiting state. As shown in FIGS. 9 and 10, when it is desired to move the backrest 52 from the third backrest position to the fourth backrest position, aside from pulling the operating unit 56 upward, it is further required to operate the safety mechanism 57 in the non-limiting state, i.e., the first limit component 522 must be pressed to extend out of the second limit component 566 so that upward movements of the operating unit 56 and the positioning member 55 are no longer limited by the second limit component 566. As a result, the operating unit 56 is allowed to move upward until the guide pins 562 abut against top slot-defining edges of the guide slots 521 in the backrest 52, and the ends of the extended segments 551 of the positioning member 55 are allowed to move by the longer distance that is sufficient to move past the height of the second stop portions 5441. At this time, the backrest 52 can be pivoted rearward to move to the fourth backrest position, which is defined by the second end walls 542 of the positioning units 54.

The function of the safety mechanism 57 is to prevent sudden movement of the backrest 52 from any of the first, second and third backrest positions to the horizontal backrest position due to unintentional operation of the operating unit 56, thereby preventing overturning of a child seated on the chair 5 due to lack of back support. Unless the safety mechanism 57 is operated in the non-limiting state, the operating unit 56 is unable to move the ends of the extending segments 551 of the positioning member 55 past the height of the second stop portions 5441 such that the backrest 52 could not be unintentionally moved to the fourth backrest position. It is noted herein that the structures of the first and second limit components 522, 566 may be modified as long as the intended effect of the safety mechanism 57 is realized. Also, the number of adjustable backrest positions, i.e., the number and distribution of the positioning blocks 543, 544 with the stop portions 5431, 5441, may vary according to design requirements.

Moreover, in view of the ratchet-teeth design of the positioning units 54, there is no need to operate the operating unit 56 when adjusting the backrest 52 in a direction from the fourth backrest position to the first backrest position. In particular, when adjusting the backrest 52 from a higher-ordered backrest position to a lower-ordered one, it is only required to pivot the backrest 52 forwardly, and the ends of the extending segments 552 of the positioning member 55 slide on the curved portions 55432, 5442 of the positioning blocks 543, 544. The spring 560 is compressed as the ends of the extending segments 551 of the positioning member 55 slide on the curved portions 5432, 5442 of the positioning blocks 543, 544 due to movement of the operating unit 56 with the positioning member 55. As soon as the ends of the extending segments 551 of the positioning member 55 move in front of the first or second stop portions 5431, 5441, the spring 560 expands to result in engagement between the ends of the extended segments 551 of the positioning member 55 and the first or second stop portions 5431, 5441.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A chair comprising:

a seat;

a backrest connected pivotally to said seat;

an armrest disposed at a lateral side of said seat, and having a receiving portion;

a positioning unit provided in said receiving portion of said armrest, and including a first positioning block formed with a first stop portion, and a second positioning block formed with a second stop portion and spaced apart from said first positioning block in a first direction, each of said first and second stop portions having a height in a second direction substantially transverse to the first direction, the height of said second stop portion being greater than that of said first stop portion;

a positioning member retained movably on a rear side of said backrest, and having one end that is extended into said receiving portion of said armrest and that is disposed to abut against a selected one of said first and second stop portions;

an operating unit connected to said positioning member and operable to drive movement of said positioning member relative to said backrest and said positioning unit in said receiving portion of said armrest for disengaging said one end of said positioning member from said first and second stop portions and for subsequently engaging said one end of said positioning member with the selected one of said first and second stop portions; and a safety mechanism including a first limit component provided on said backrest, and a second limit component provided on said operating unit, said safety mechanism being operable in one of a limiting state, where said first limit component cooperates with said second limit component so that said one end of said positioning member is displaceable in the second direction in response to operation of said operating unit by a shorter distance sufficient to move past the height of said first stop portion but insufficient to move past the height of said second stop portion, and a non-limiting state, where said first and second limit components permit displacement of said one end of said positioning member in the second direction in response to operation of said operating unit by a longer distance that is longer than the shorter distance and that is sufficient for said one end of said positioning member to move past the height of said second stop portion.

2. The chair as claimed in claim 1, further comprising a spring for biasing said operating unit toward said armrest, said spring having a first end acting on said backrest and a second end acting on said operating unit.

3. The chair as claimed in claim 2, wherein said operating unit is formed with a chamber for accommodating said spring, and said backrest is formed with a tab that extends into said chamber to abut against said first end of said spring.

4. The chair as claimed in claim 1, wherein said second limit component is an elongate slot, and said first limit component is a resilient finger that extends into said slot when said safety mechanism is in the limiting state, said resilient finger being depressible to extend out of said slot to switch said safety mechanism from the limiting state to the non-limiting state.

5. The chair as claimed in claim 1, wherein said first positioning block further has a curved portion opposite to said first stop portion and facing toward said second positioning block.

6. The chair as claimed in claim 1, wherein said positioning member includes an extending segment formed with said one end, and a connecting segment connected to said extending segment and further connected to said operating unit.

7. The chair as claimed in claim 6, wherein said operating unit is formed with an aligned pair of retaining grooves for retaining said connecting segment of said positioning member.

8. The chair as claimed in claim 7, wherein said operating unit includes:

a cap body having a peripheral edge formed with said retaining grooves; and a tongue that extends downwardly and outwardly from said cap body.

9. The chair as claimed in claim 8, wherein said second limit component is an elongate slot formed in said tongue, and said first limit component is a resilient finger that extends into said slot when said safety mechanism is in the limiting state, and that extends out of said slot when said safety mechanism is operated in the non-limiting state.

10. The chair as claimed in claim 8, wherein said backrest is formed with an elongate guide slot, said cap body of said operating unit being provided with a guide pin that is slidably retained at said guide slot to guide movement of said operating unit relative to said backrest.

11. A chair comprising:

a seat;

a backrest connected pivotally to said seat;

a receiving portion disposed at a lateral side of said seat;

a positioning unit provided in said receiving portion, and having shorter and taller stop portions respectively defining vertical and horizontal backrest positions;

a positioning member retained movably on a rear side of said backrest, and having one end that is extended into said receiving portion to engage a selected one of said shorter and taller stop portions;

an operating unit connected to said positioning member and operable to drive movement of said positioning member relative to said backrest and said positioning unit in said receiving portion; and a safety mechanism including a first limit component provided on said backrest, and a second limit component provided on said operating unit, said safety mechanism being operable in one of a limiting state, where said first limit component cooperates with said second limit component to limit extent of displacement of said one end of said positioning member such that said one end of said positioning member is unable to move past said taller stop portion, and a non-limiting state, where said first and second limit components permit displacement of said one end of said positioning member in response to operation of said operating unit by a distance that is sufficient for said one end of said positioning member to move past said taller stop portion.

12. The chair as claimed in claim 11, wherein said second limit component is an elongate slot, and said first limit component is a resilient finger that extends into said slot when said safety mechanism is in the limiting state, said resilient finger being depressible to extend out of said slot to switch said safety mechanism from the limiting state to the non-limiting state.

13. The chair as claimed in claim 11, wherein said operating unit includes a cap body that has a peripheral edge formed with an aligned pair of retaining grooves, and a tongue that extends downwardly and outwardly from said cap body, said positioning member being retained by said retaining grooves of said cap body such that said operating unit is able to drive movement of said positioning member.

14. The chair as claimed in claim 13, wherein said backrest is formed with an elongate guide slot, said cap body of said operating unit being provided with a guide pin that is slidably retained at said guide slot to guide movement of said operating unit relative to said backrest.

* * * * *